US008297134B2

(12) United States Patent
Wilmer

(10) Patent No.: US 8,297,134 B2
(45) Date of Patent: Oct. 30, 2012

(54) PIPETTING DEVICE

(75) Inventor: Jens Wilmer, Ahrensburg (DE)

(73) Assignee: Eppendorf AG, Hamburg (DE)

( * ) Notice: Subject to any disclaimer, the term of this patent is extended or adjusted under 35 U.S.C. 154(b) by 533 days.

(21) Appl. No.: 12/557,926

(22) Filed: Sep. 11, 2009

(65) Prior Publication Data

US 2010/0083775 A1 Apr. 8, 2010

Related U.S. Application Data

(60) Provisional application No. 61/097,393, filed on Sep. 16, 2008.

(30) Foreign Application Priority Data

Sep. 12, 2008 (DE) ..... 10 2008 048 252

(51) Int. Cl.
*B01L 3/02* (2006.01)

(52) U.S. Cl. ..... 73/864.18; 73/864.14

(58) Field of Classification Search ..... 73/864.14, 73/864.16, 864.18; 422/516, 525, 925, 931–932
See application file for complete search history.

(56) References Cited

U.S. PATENT DOCUMENTS

| | | | | | |
|---|---|---|---|---|---|
| 2,626,087 | A * | 1/1953 | Howard et al. | ..... | 422/925 X |
| 3,669,319 | A * | 6/1972 | Sanz | ..... | 222/309 |
| 4,096,751 | A | 6/1978 | Withers et al. | | |
| 4,098,125 | A | 7/1978 | Lee | | |
| 4,165,646 | A * | 8/1979 | Shapiro | ..... | 73/864.18 X |
| 4,395,921 | A * | 8/1983 | Oppenlander | ..... | 73/864.18 |
| 4,501,163 | A | 2/1985 | MacDermott et al. | | |
| 4,744,955 | A * | 5/1988 | Shapiro | ..... | 73/864.18 X |
| 4,909,991 | A * | 3/1990 | Oshikubo | ..... | 73/864.18 X |
| 5,104,624 | A | 4/1992 | Labriola | | |
| 5,364,595 | A | 11/1994 | Smith | | |
| 5,413,006 | A * | 5/1995 | D'Autry | ..... | 73/864.18 |
| 5,650,124 | A | 7/1997 | Gilson | | |
| 5,849,248 | A | 12/1998 | Homberg | | |
| 6,959,616 | B2 * | 11/2005 | Viot | ..... | 73/864.18 |
| 7,175,813 | B2 * | 2/2007 | Petrek et al. | ..... | 422/516 |
| 7,204,163 | B2 * | 4/2007 | Uldry et al. | ..... | 73/864.18 |
| 2003/0101831 | A1 * | 6/2003 | Viot | ..... | 73/864.01 |
| 2005/0155439 | A1 | 7/2005 | Belgardt | | |
| 2005/0158214 | A1 * | 7/2005 | Cote et al. | ..... | 422/400 |
| 2007/0014696 | A1 | 1/2007 | Molitor | | |
| 2007/0169571 | A1 * | 7/2007 | May et al. | ..... | 73/864.18 X |

FOREIGN PATENT DOCUMENTS

| | | | | | |
|---|---|---|---|---|---|
| DE | 601 04 099 | T2 | 6/2005 | | |
| DE | 10 2005 033 378 | A1 | 1/2007 | | |
| EP | 67605 | A * | 12/1982 | | |
| EP | 112887 | B * | 2/1986 | | |
| EP | 178023 | A2 * | 4/1986 | ..... | 604/36 |
| EP | 1 557 222 | A2 | 1/2005 | | |
| GB | 1255359 | A * | 12/1971 | | |
| GB | 2 021 972 | A | 12/1978 | | |
| WO | WO 9203714 | A1 * | 3/1992 | ..... | 73/864.17 |

(Continued)

*Primary Examiner* — Thomas P Noland
(74) *Attorney, Agent, or Firm* — Vidas, Arrett & Steinkraus, P.A.

(57) ABSTRACT

The present invention is related to a pipetting device with a throw-off system for detachably connecting with at least one pipette tip, at least one displacement device, a driving device for driving a displacement member of the displacement device and an adjustment device with a lead screw nut and a lead screw for adjusting the metering volume.

26 Claims, 10 Drawing Sheets

FOREIGN PATENT DOCUMENTS

| | | | |
|---|---|---|---|
| WO | WO 9213638 | A1 * | 8/1992 |
| WO | WO 0161308 | A1 * | 8/2001 |
| WO | 01/76747 | A1 | 10/2001 |
| WO | 2005/093787 | A1 | 10/2005 |

* cited by examiner

Figure 2:
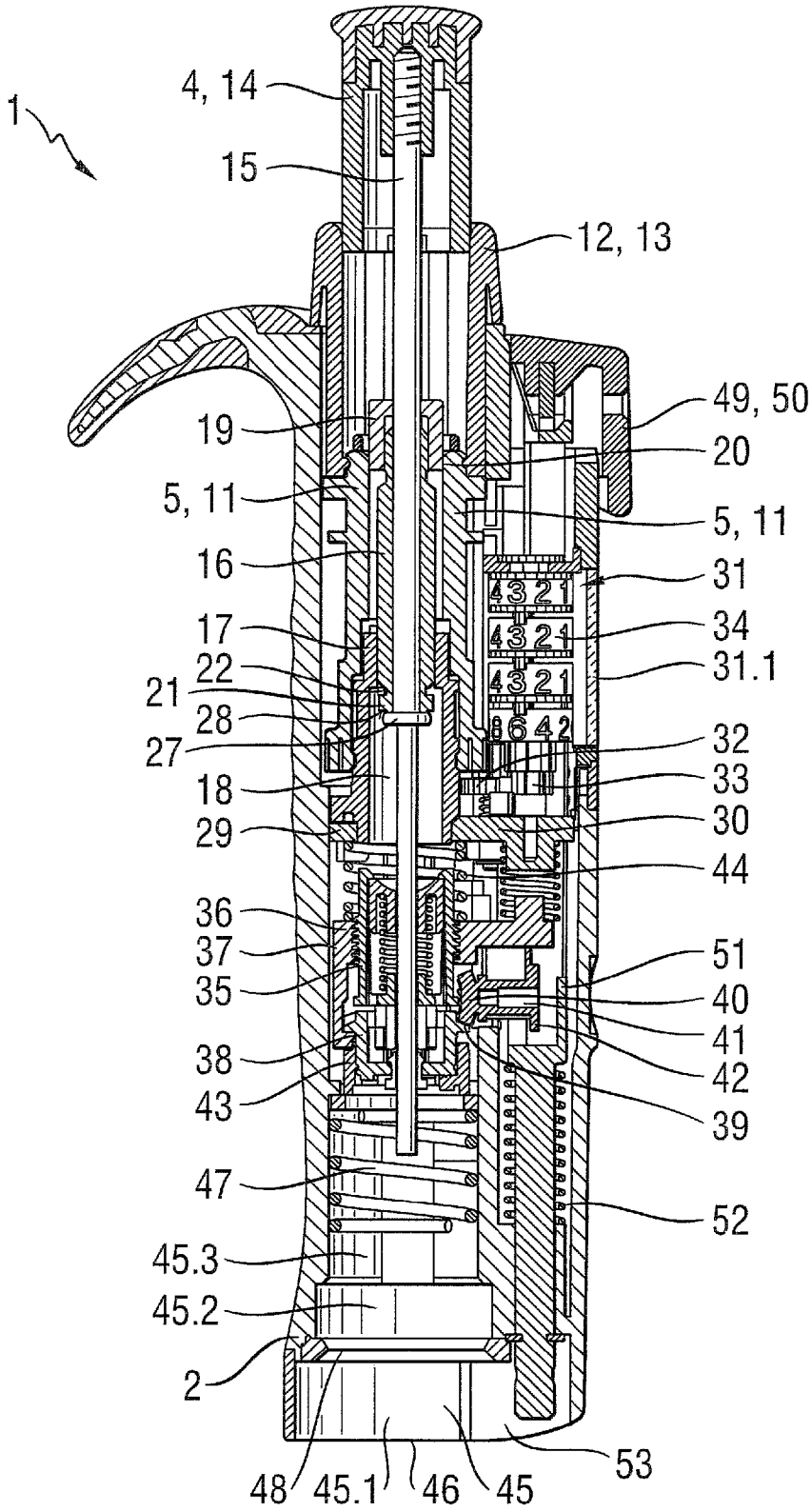

Fig. 2.1
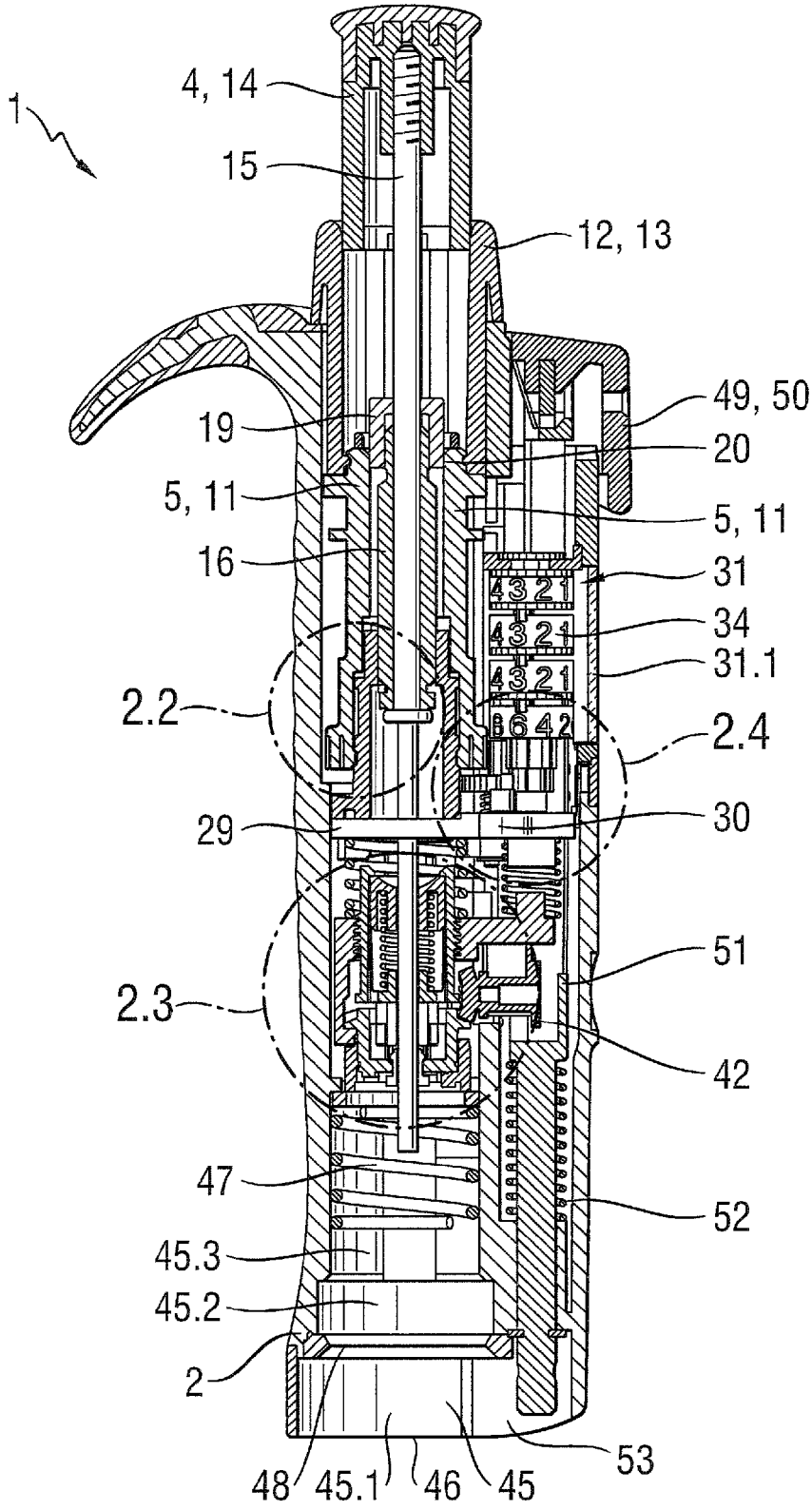

Fig. 2.2
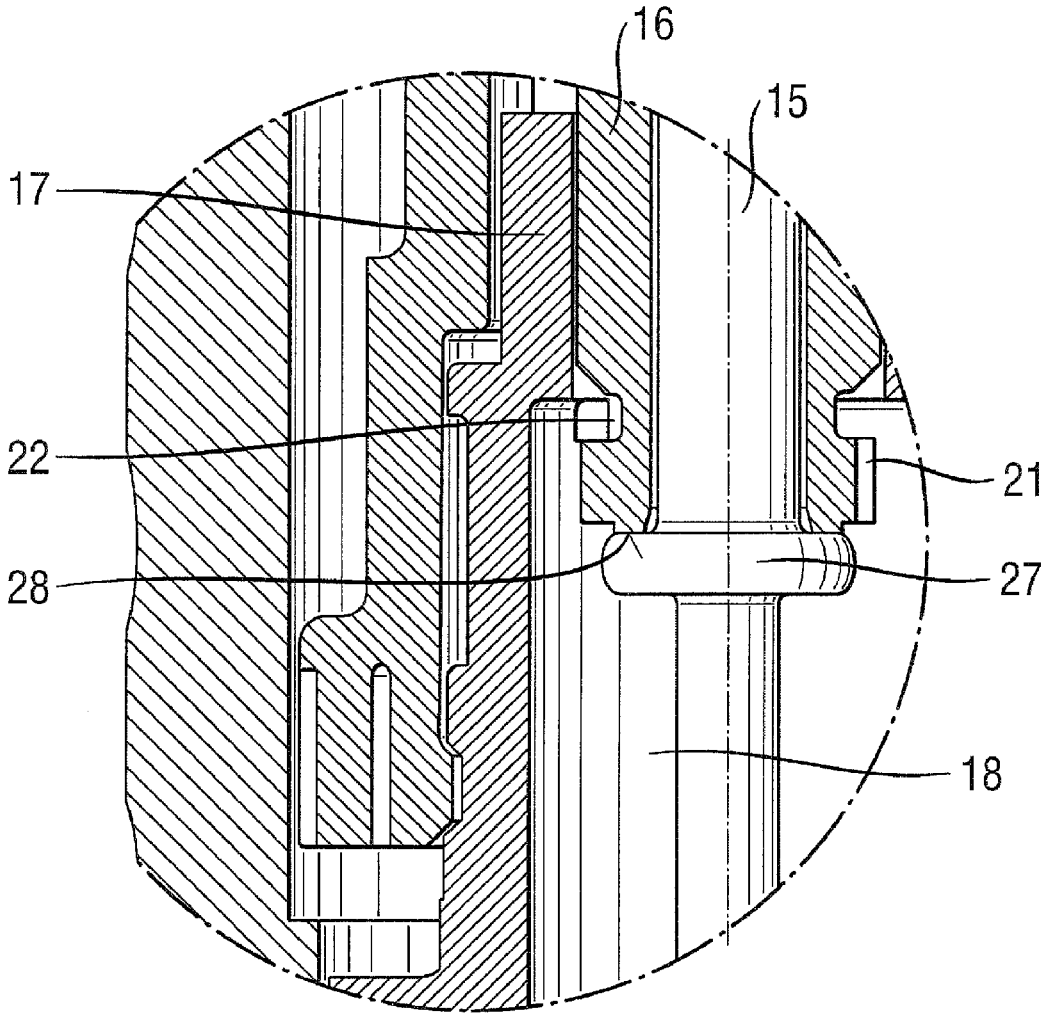

Fig. 2.3
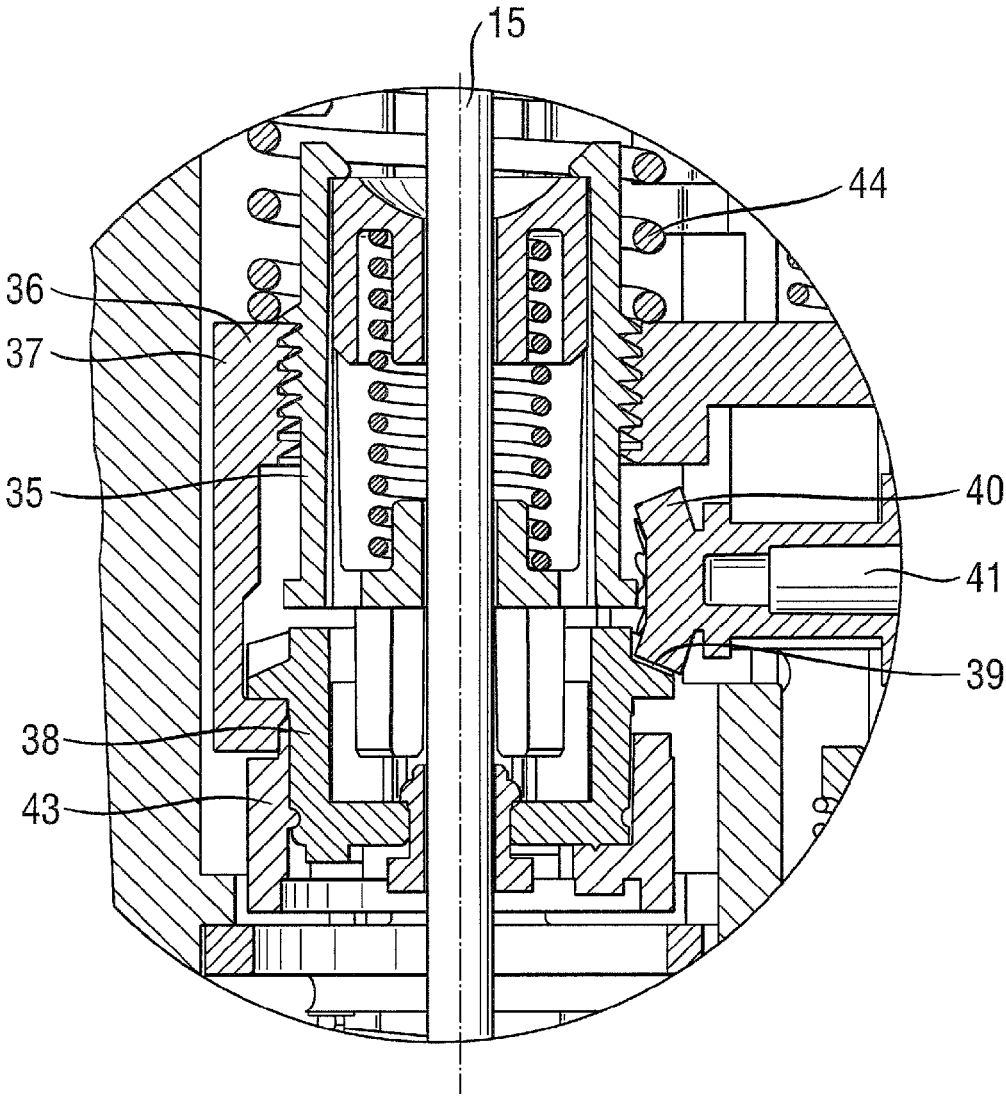

Fig. 2.4
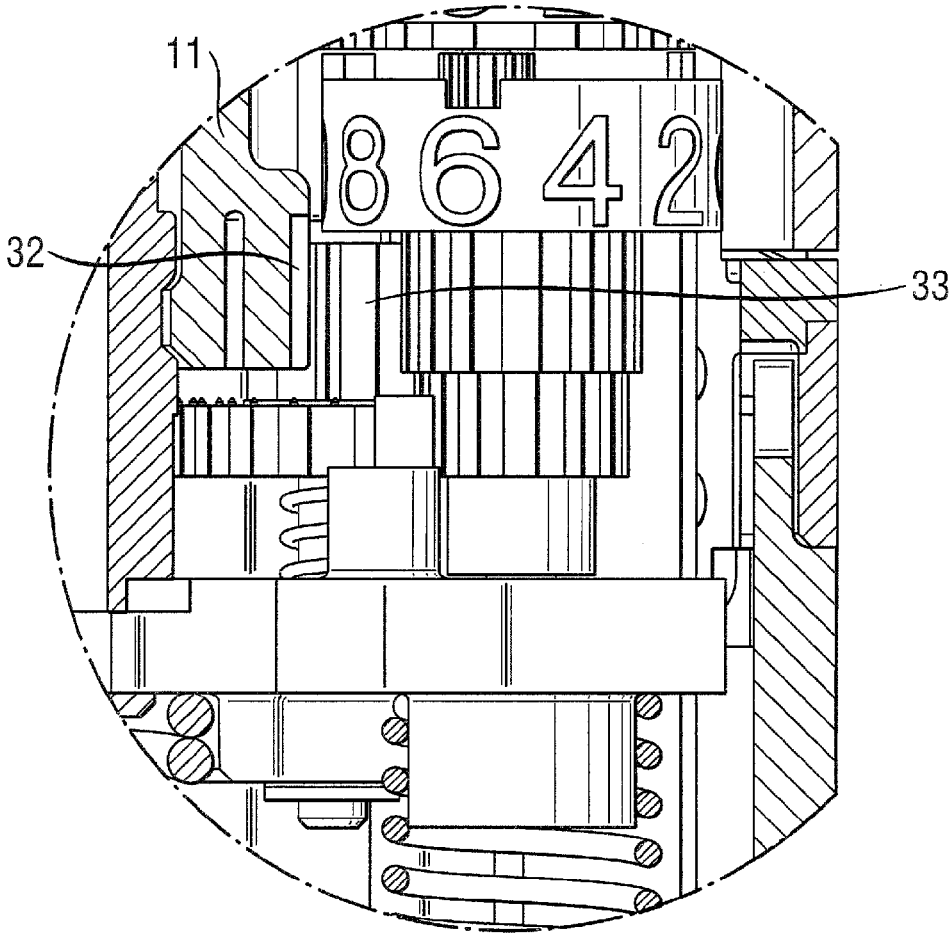

PIPETTING DEVICE

CROSS-REFERENCE TO RELATED APPLICATIONS

This application is a non-provisional of 61/097,393 filed Sep. 16, 2008.

STATEMENT REGARDING FEDERALLY SPONSORED RESEARCH

Not applicable.

BACKGROUND OF THE INVENTION

The present invention is related to a pipetting device with means for detachably connecting with at least one pipette tip, at least one displacement device, a driving device for driving a displacement member of the displacement device and an adjustment device with a lead screw nut and a lead screw for adjusting the metering volume.

Pipetting devices are used in the laboratory, in particular, for the metering of liquids. The liquids are picked up and discharged in pipette tips. In air cushion pipettes, a displacement device for a gas is integrated into the pipetting device and communicatingly connected with at least one pipette tip. An air cushion is displaced by means of the displacement device, so that liquid is sucked into the pipette tip and ejected out of it. Frequently, the displacement device is a cylinder with a plunger movable therein. The means for detachably connecting with at least one pipette tip are realised as a put-up cone or as a blind hole, for instance. A hole in the front side of the put-up cone or in the bottom of the blind hole is connected to a displacement chamber of the displacement device.

The pipette tips are detachably connected to the pipetting device, so that they can be replaced by new pipette tips after use. Through this, carryovers and contaminations can be avoided at subsequent meterings. Pipette tips for one time use are available from plastics at a reasonable price.

The metering volume of the liquid picked up and discharged by means of the pipetting device is adjustable by means of the adjustment device. In order to adjust the metering volume, the stroke travel which the plunger can perform in the cylinder is changed. For this purpose, a stop is shifted which co-operates with a counter-stop on a lifting rod which shifts the plunger, in order to limit the stroke travel of the lifting rod. The stop is arranged on the front side of a lead screw, which is screwable in a lead screw nut stationary with respect to the displacement chamber and which is guided through the lifting rod. The counter-stop is a washer or bead, respectively, projecting radially from the lifting rod. On the other end, the stroke travel is limited by another stop which co-operates with the bead on the lifting rod or the plunger.

In conventional pipetting devices, lead screw nut and lead screw are produced separately and provided with threads. Due to manufacturing tolerances, the lead screw has a clearance in the nut, which may lead to metering inaccuracies.

Further, there are pipetting devices in which the lead screw nut made of plastic material is produced with a threadless bore at first, and the internal thread of the lead screw nut is then formed by screwing in a lead screw made of metal and provided with an external thread into the bore. These realisations avoid a clearance between lead screw nut and lead screw. However, they have the disadvantage that the adjustment of the metering volumes in pipetting devices of different magnitude, which differ in the adjustment ranges of their metering volumes (for instance, 0.5-10 μl, 10-100 μl, 100-1000 μl), is accompanied by a very high expense of force. Namely, due to the thread friction decreasing with increasing thread steepness, the expense of force for adjusting the metering volume is greater at pipetting devices with small adjustment range than the expense of force for adjusting the metering volume at pipetting devices with great adjustment range.

Starting from this, the present invention is based on the objective to provide a pipetting device which can be more easily operated with a defined adjustment force for different adjustment ranges.

BRIEF SUMMARY OF THE INVENTION

The pipetting device according to the present invention has means for detachably connecting with at least one pipette tip and at least one displacement device having a displacement chamber and a displacement member movably arranged therein, for sucking in and ejecting liquid into and out of the at least one pipette tip, or means for detachably connecting with at least one syringe with a cylinder and a plunger relocatable therein, a lifting rod for driving the displacement member or the plunger of a syringe, a driving means for driving the lifting rod, an adjustment device for adjusting the metering volume with a lead screw nut and a lead screw, wherein one of the components lead screw nut and lead screw is stationary with respect to the displacement chamber or the cylinder of the connected syringe, and the other component is screwable with respect to the stationary component and has a stop, to which a counter-stop of the lifting rod is related, wherein the lead screw has a first external thread and at least one further external thread with a thread form shaped different than that of the first external thread, and the lead screw nut has at least one related internal thread or the lead screw nut has a first internal thread and at least one further internal thread with a thread form shaped different than that of the first internal thread, and the lead screw has at least one related external thread, and wherein on the further external thread of the lead screw or the further internal thread of the lead screw nut, the lead screw nut features at least in parts a distance to the lead screw in the radial direction to the axis of the lead screw in the level of the outer diameter and/or inner diameter of the external thread of the lead screw.

Preferably, the related internal thread of the lead screw nut or the related external thread of the lead screw is produced or has already been produced at least in parts by screwing in the lead screw into the lead screw nut or by screwing on the lead screw nut onto the lead screw.

The pipetting devices according to the present invention are distinguished in that on the additional, at least second external thread of the lead screw or internal thread of the lead screw nut, there is at least in parts a distance between the lead screw nut and the lead screw in the radial direction to the axis of the lead screw in the level of the outer diameter and/or inner diameter of the external thread of the lead screw, through which defined adjustment forces according to the desire of the user of the pipetting device, reduced adjustment forces in particular, are made possible. The distance between lead screw nut and external thread should be preferably greater than 0.015 mm, more preferably be in the range from 0.020 mm to 0.06 mm In the pipetting device of the present invention, preferably at least one internal thread of the lead screw nut is formed by screwing in the lead screw provided with a first external thread and at least one further external thread having a thread form shaped different than that of the first external thread, or by screwing on the lead screw nut onto this lead screw. As an alternative, at least one external thread of the lead screw is formed by screwing in the lead screw into the lead screw nut provided with a first internal thread and at least one further internal thread having a differently shaped thread form, or by screwing on this lead screw nut onto the lead screw. In the following, as a simplification, the case is discussed in principle that the lead screw is screwed into the stationary lead screw nut. In turn, the explanations apply also for the case of screwing on the lead screw nut onto the stationary lead screw.

In case that the internal thread of the lead screw nut is formed by means of a lead screw which is provided with a first external thread and a further external thread, the lead screw nut may originally have a bore, in which at least one internal thread is formed by screwing in the lead screw. Further, the lead screw nut can be already provided with a partly prefabricated internal thread, which is completed by screwing in the lead screw. Further, it is possible to realise the lead screw nut originally without bore and to produce bore and internal thread by screwing in a lead screw which is realised like a self-drilling screw.

In case that the external thread of the lead screw is formed by means of a lead screw nut which is provided with a first internal thread and at least one further internal thread, the lead screw may be a cylindrical round bar, on which at least one external thread is formed by screwing on the lead screw nut. Further, the lead screw can already be provided with at least one partially prefabricated external thread, which is completed by screwing on the lead screw nut.

The first external thread or the first internal thread, respectively, can be shaped differently than the at least one further external thread or the at least one further internal thread, respectively, in that it has at least one different thread size and/or a different thread shape. A differently shaped thread dimension is the outer diameter and/or the inner diameter and/or the pitch diameter and/or the included thread angle and/or the thread pitch, for instance. However, there is preferably no deviation in the thread pitch. Differently shaped thread forms are a thread with a triangular shape, a thread with a trapezoidal shape, a round thread or a sawtooth thread. The mentioned thread parameters or terms, respectively, are used according to the definitions in pertinent norms (ISO e.g.) for threads.

When the lead screw having the prefabricated external threads is screwed into the lead screw nut, at least one complementary internal thread is formed in the latter, so that it is made sure that the lead screw is held in the lead screw nut without clearance. Accordingly, when the lead screw is screwed into a lead screw nut with prefabricated internal threads, at least one complementary external thread is formed on the lead screw, so that the lead screw is held in the lead screw nut without clearance. In this, the first external thread of the lead screw or the first internal thread of the lead screw nut, respectively, can be selected such that the tread connection between lead screw and lead screw nut features a sufficient extraction resistance. The adjustment force to be applied for screwing the lead screw with respect to the lead screw nut or the torque which must be applied for this, respectively, depends on the different shaping of the thread forms of the first external thread and the at least one further external thread of the lead screw or of the first internal thread and the at least one further internal thread of the lead screw nut, respectively. Thus, by determining the different shapings of said external threads or internal threads, respectively, the adjustment force can be determined. Through this, pipetting devices with defined adjustment forces can be provided. In particular, pipetting devices for different adjustment ranges of the metering volumes can be realised such that they have approximately the same adjustment forces.

In conventional pipetting devices, in which the internal thread of the lead screw nut is formed by screwing in a lead screw provided with an external thread into a threadless bore of the lead screw nut, the adjustment force for the adjustment could in fact be influenced by dimensioning the external thread. However, the enlargements of the friction surfaces on the external thread and the internal thread necessary for this at large pitches are not possible, due to small diameters of the lead screw. At small pitches, the possibilities to influence the frictional forces are limited due to the necessary reduction of the friction surfaces and the loss of extraction resistance accompanied by this. To the contrary, in the pipetting device according to the present invention, essentially coincident adjustment forces can be achieved even at pitches which strongly differ from each other, with sufficient load bearing force, due to the differently shaped thread forms of the lead screw and the lead screw nut, respectively.

Through this, it is possible to determine or to reduce, respectively, the force which is required to screw in the lead screw by determining the shaping of the first external thread and at least one further external thread or of the first internal thread and at least one further internal thread, respectively. Thus, pipetting devices of different magnitude which differ through their adjustment ranges of the metering volumes, can be realised with the same adjustment force in a user-friendly fashion. In that the internal thread of the lead screw nut or the external thread of the lead screw, respectively, is produced by screwing in the lead screw, freedom of clearance of the adjustment device and good metering accuracy is guaranteed.

According to a preferred embodiment, in the whole adjustment range of the adjustment device for adjusting the metering volume, the further external thread engages into the internal thread produced by means of the lead screw, or the external thread produced by means of the lead screw nut engages into the further internal thread. Through this, it is made sure that the adjustment device can be adjusted with a defined torque over the whole adjustment range.

In one embodiment, the lead screw or the lead screw nut is single started, and the further external thread is added to the first external thread or the further internal thread is added to the first internal thread. This is advantageous in particular when the further external thread is less marked than the first external thread, or the further internal thread is less marked than the first internal thread. The cross section of the less marked thread form fills the cross section of the more marked thread form only in parts.

In case that the internal thread is produced by means of the lead screw, this has the following consequences: By screwing in the lead screw having the first external thread into the lead screw nut, an internal thread complementary to the first external thread is produced in the lead screw nut. When the first external thread engages into the internal thread, the load-bearing depth is at maximum, i.e. the overlap of the thread flanks of the external thread and the internal thread, measured perpendicular to the axis of the lead screw, has the maximum value. When the lead screw is screwed into the lead screw nut by the further external thread, the load-bearing depth is reduced, because the thread form of the further external thread is less marked. Due to the reduced load-bearing depth, the friction between internal thread and external thread is reduced. The friction between internal thread and external thread is reduced in a particularly high degree when the further external thread features a thread form which has no tips, in difference to the first external thread, so that the particularly strong friction on the tips of the thread form is no more existing. The torque which must be applied in order to screw in the lead screw can be reduced to a defined value through this.

In order to produce the internal thread, the lead screw can be screwed into the lead screw nut with the first external thread at first and thereafter with the further external thread, or at first with the further external thread and thereafter with the first external thread. If necessary, the internal thread is preformed in the first screwing in of the first or the further external thread, and completed by screwing in the further or the first external thread.

In case that the external thread is produced by means of a single threaded lead screw nut, in which the further internal thread is less marked than the first internal thread, there is in an analogous fashion a maximum load bearing depth when the external thread engages into the first internal thread, and a reduced load bearing depth when the external thread engages into the further internal thread, with corresponding effects on the torque which must be applied when screwing in.

In a single lead screw or lead screw nut, the adjustment range of the adjustment device can be limited by means which make sure that in the adjustment range, exclusively the further external thread engages into the internal thread or the further internal thread into the external thread. In this, it may be dealt with means arranged in the casing of the pipetting device, which limit the range of the axial movement of the lead screw. These means can be installed in the casing after the first external thread has formed the internal thread, or the first internal thread has formed the external thread. When the external thread is formed by a single threaded lead screw nut, the lead screw may have a reduced diameter, which is guided through the first internal thread of the lead screw nut in the adjustment range, so that no thread engagement takes place there.

According to one embodiment, the lead screw or the lead screw nut is multi started, and a first thread path of the multi started thread is provided by the first external thread or the first internal thread, and a further thread path of the multi started thread is provided by the further external thread or the further internal thread. When screwing in the thread-forming, multi started lead screw into the lead screw nut, a multi started internal thread is produced therein. The first external thread forms a first internal thread and the further external thread a further internal thread. As the thread form of the first external thread is shaped different from the thread form of the further external thread, the friction surface between the first external thread and the first internal thread is greater or smaller than the friction surface between the further external thread and the further internal thread. As a consequence, the portion of the adjustment force falling to the first external thread is smaller or greater than the portion falling to the further external thread. Thus, by selecting the shaping of the thread forms of the first and the further external thread, the desired torque can be realised. In particular, this may be achieved by varying the shaping of the further external thread, but maintaining the shaping of the first external thread. The clearance-free arrangement of the lead screw in the lead screw nut and a sufficient extraction force can be achieved without further problems.

Corresponding effects on the adjustment force or the torque required for screwing in, respectively, result when a lead screw is screwed into a thread-forming, multi started lead screw nut.

According to one embodiment, the internal thread is produced by screwing in the lead screw into an even cylindrical bore of the lead screw nut. The internal thread is then produced completely by screwing in the lead screw into the lead screw nut. In an analogous embodiment, the external thread of the lead screw is produced by screwing in an even cylindrical round bar into the thread-forming lead screw nut.

In a further embodiment, the internal thread is produced by screwing in the lead screw into a bore of the lead screw nut, the bore being provided with inwardly projecting noses. As a consequence, the internal thread is formed in the inwardly projecting noses of the bore. The screw-in moment which must be applied for producing the internal thread is reduced through this. Further, the friction force between the internal thread and the external thread which has to be overcome in the adjustment is reduced, and a good guiding of the lead screw in the lead screw nut is achieved in spite of this. Preferably, the noses are inwardly projecting ribs, which extend in the axial direction of the bore. According to an analogous embodiment, the external thread is produced by screwing in the lead screw, provided with outwardly projecting noses, into the thread-forming lead screw nut. The outwardly projecting noses extend preferably in the axial direction of the lead screw.

According to a further embodiment, the internal thread is produced by screwing in the lead screw into a lead screw nut provided with a partly prefabricated internal thread. The partly prefabricated internal thread is completed by screwing in the lead screw. The torque required for this is significantly reduced with respect to an embodiment in which the internal thread is made completely by screwing in the lead screw. The partly prefabricated internal thread may be present on a bore which is soft cylindrical for the rest, or on a bore that is provided with inwardly projecting noses, and it can be completed by threading in the lead screw. According to an analogous embodiment, the external thread is produced by screwing in a lead screw having a partly prefabricated external thread into the thread-forming lead screw nut.

By suitable realisation of the lead screw or of the lead screw nut, the internal thread can be produced by the lead screw, or the external thread by the lead screw nut, by machining and/or in a non-machining manner. Preferably, it is produced in a non-machining manner. For the production by machining, the lead screw can be realised in the kind of a tap, or the lead screw nut in the kind of an external thread chaser. In a non-machining manner, the internal thread or the external thread can be produced by a lead screw or lead screw nut realised in the kind of a fluteless tap. The internal thread or the external thread is preferably provided with flutes.

Different kinds of threads can be taken into consideration for the first and further external threads and for the first and further internal threads, for instance threads with a trapezoidal shape, round threads or sawtooth threads. Preferably, the first external thread or the first internal thread is a thread with a triangular shape, and the further external thread or the further internal thread is a thread with a trapezoidal shape.

Different materials can be used for the lead screw nut and the lead screw. In case that the internal thread is made by means of the lead screw, at least in the region of the internal thread, the lead screw nut is preferably of a softer material than the lead screw at least in the region of the external thread, because this facilitates the production of the internal thread. The present invention embraces embodiments in which only that region of the lead screw nut in which the internal thread is produced consists of a softer material than the first and further external thread of the lead screw. Further, the present invention embraces embodiments in which the lead screw consists of a harder material than the lead screw nut in the region of the internal thread only in the region of the first and the further external thread. A lead screw nut with an inner layer of a softer material or a lead screw with an outer layer of a harder material, respectively, may feature a sleeve from a suitable material which is arranged in the inside or on the outside, respectively. According to a further embodiment, the lead screw nut is made of a plastic material at least in the region of the internal thread, and/or the lead screw is made of a metal at least in the region of the external thread. Preferably, the lead screw nut consists of a softer material altogether, and the lead screw of a harder material altogether. In analogy, in case that the external thread is made by means of the lead screw nut, the lead screw can consist at least in the region of the external thread of a softer material than the lead screw nut at least in the region of the internal thread, in order to facilitate the making of the external thread.

The plastic material is preferably a toughened high-temperature resistant plastic material. Toughened plastics have a small abrasion, so that strong changes of the friction between lead screw nut and lead screw in the course of time are avoided. High temperature resistant plastics can be steam cured without compromising their material properties. Suitable plastic materials are PEEK (polyetherketone) or PEI (polyetherimide).

When using plastic materials, those mentioned above in particular, as a material of the friction partners lead screw nut—lead screw, the advantage of the present invention becomes particularly marked, namely that the friction between the friction partners is reduced through the other thread form of the further internal thread or external thread. As a metal, brass or stainless steel may be used e.g.

According to one embodiment, the torque for moving the lead screw in the lead screw nut is about 50 mNm at maximum, i.e. $55\times10^{-3}$ Nm. Preferably, it is about 40 mNm at maximum. Tolerance caused deviations from the mentioned upper limits are possible.

The lifting rod can be arranged completely outside the lead screw. Preferably, the stop is formed by a front side of the lead screw or the lead screw nut. According to a preferred embodiment, the lead screw features a channel which partly accommodates the lifting rod. Further preferably, the channel extends through the whole lead screw, and the counter-stop and the driving means are arranged on different sides of the lead screw.

The driving means of the lifting rod is a drive motor, for instance. According to a preferred embodiment, the driving means of the lifting rod is an actuation button. The actuation button is preferably actuable against the action of a spring device, which shifts the lifting rod into a starting position upon release of load, in which the lifting rod is farthest away from the displacement chamber.

According to a further embodiment, the lead screw nut is stationary with respect to the displacement chamber, and the lead screw is screwable with respect to the lead screw nut.

BRIEF DESCRIPTION OF THE VIEW OF THE DRAWINGS

Figure 1:
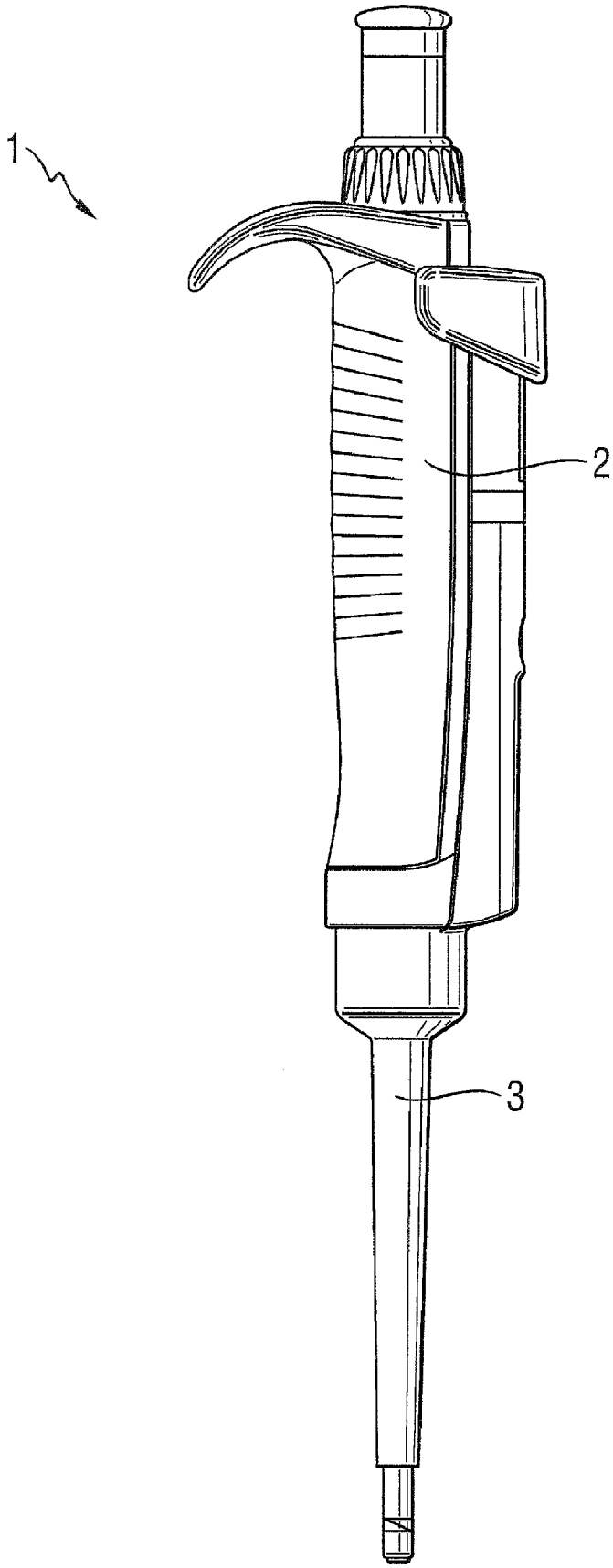
Figure 3:
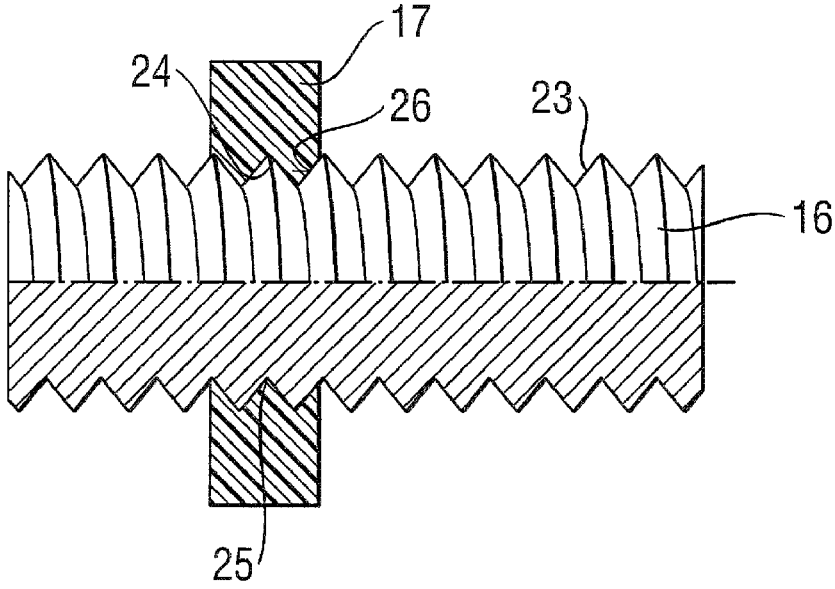
Figure 5:
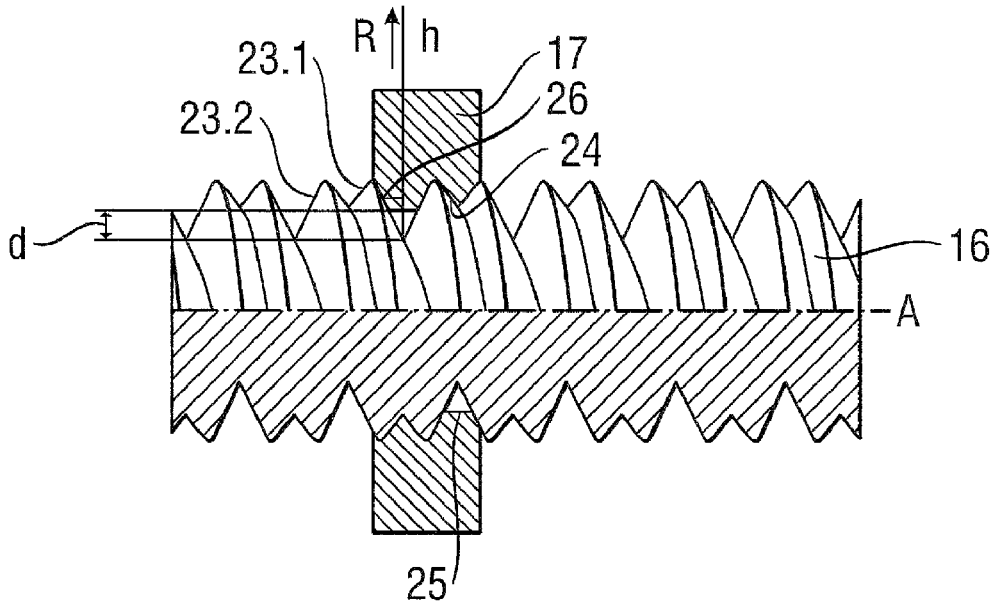
Figure 4:
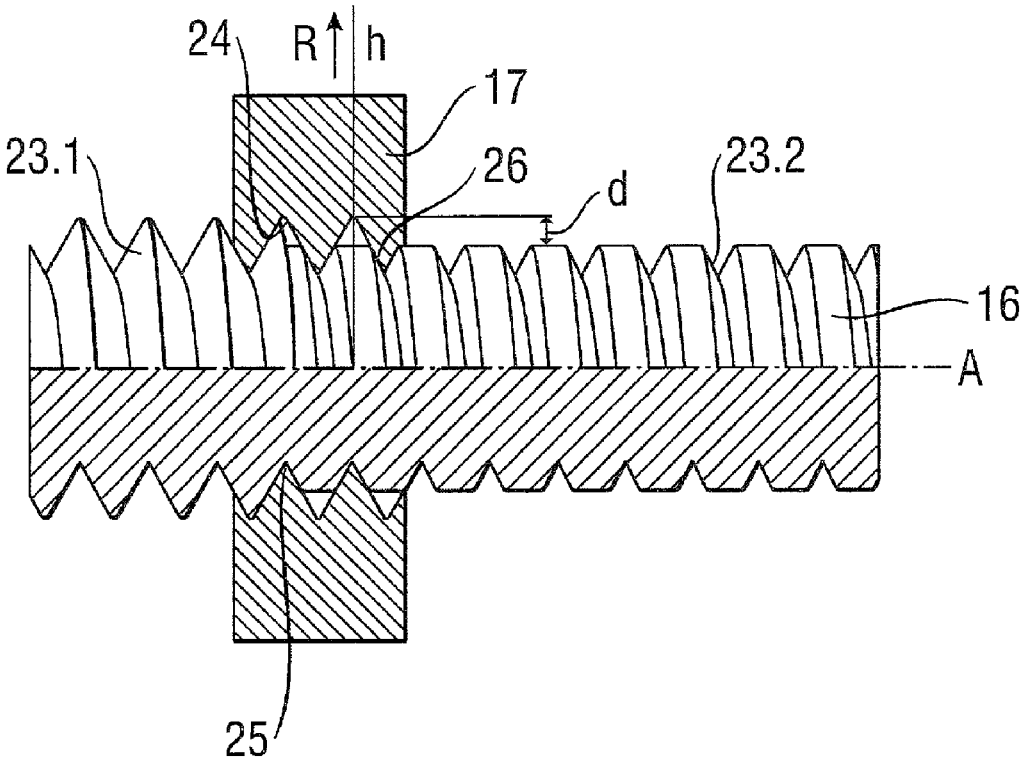
Figure 6:
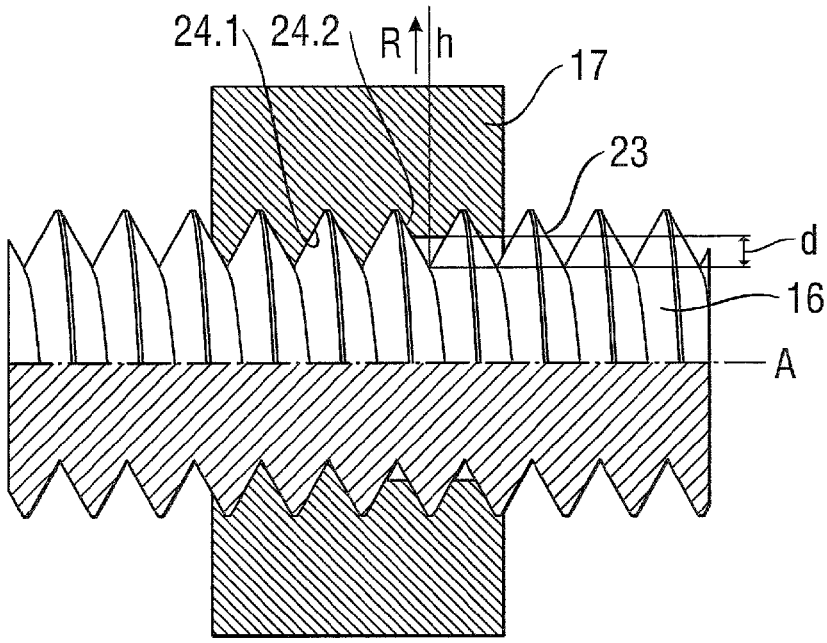
Figure 7:
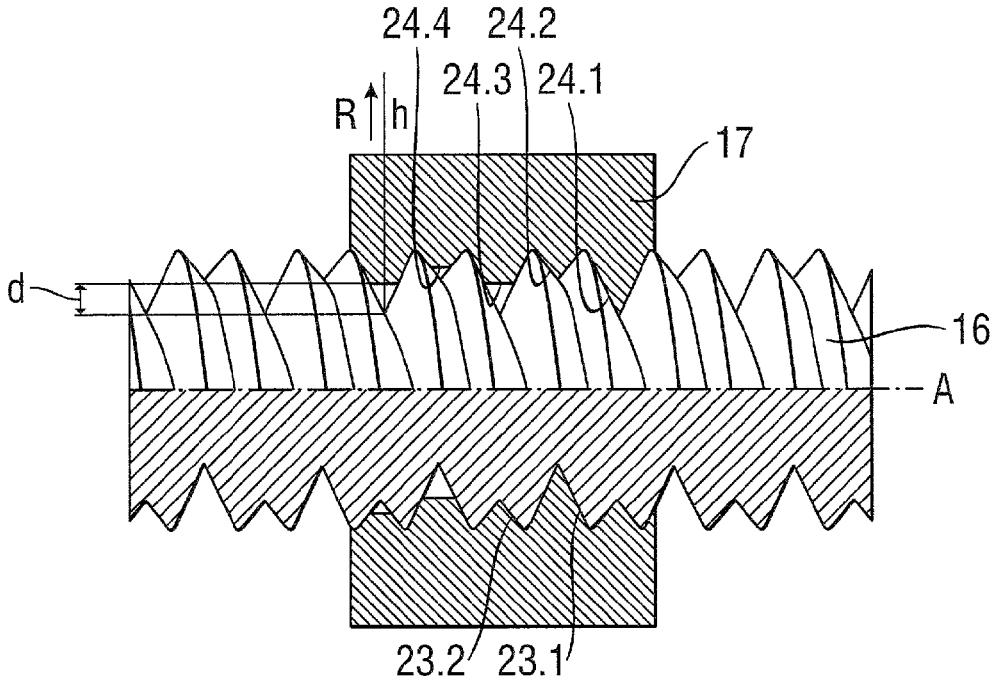
Figure 8:
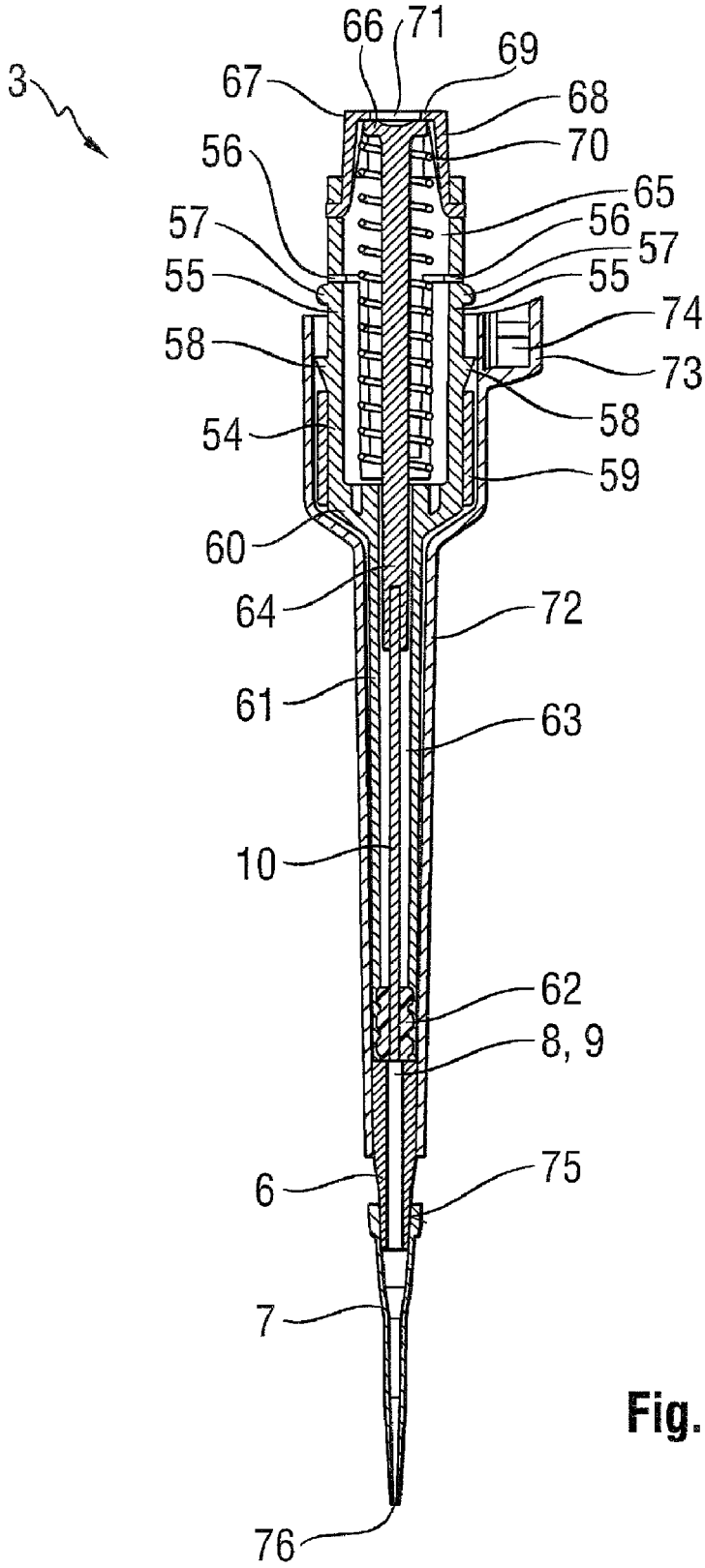

The present invention will be explained in more detail by means of the attached drawings of examples of its realisation. In the drawings show:

FIG. 1 a pipetting device in a side view;

FIG. 2 the upper casing part of the same pipetting device in a longitudinal section;

FIG. 2.1 the same upper casing part in a longitudinal section with details surrounded by circles;

FIG. 2.2 detail 2.2 of FIG. 2.1;

FIG. 2.3 detail 2.3 of FIG. 2.1;

FIG. 2.4 detail 2.4 of FIG. 2.1;

FIG. 3 lead screw and lead screw nut of a conventional pipetting device in an enlarged longitudinal section;

FIG. 4 lead screw and lead screw nut of the pipetting device according to the present invention in an enlarged longitudinal section;

FIG. 5 alternative lead screw and lead screw nut for the pipetting device in an enlarged longitudinal section;

FIG. 6 alternative lead screw and lead screw nut for the pipetting device in an enlarged longitudinal section;

FIG. 7 alternative lead screw and lead screw nut for the pipetting device in an enlarged longitudinal section;

FIG. 8 one-channel lower chasing part of the same pipetting device in a cross section.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated The designations "on top", "on the bottom", "horizontal", "vertical" and "front", "rear" are related to the orientation of the pipetting device in the drawings. In this, it is dealt with an orientation of the pipetting device in which a pipette tip connected to it is arranged with its tip opening at the bottom side, in order to pick up liquid from a vessel situated below the pipetting device, or to discharge it into such a vessel.

The pipetting device according to FIGS. 1, 2 and 8 has a longitudinal casing shaped to be a handhold, with an upper casing part 2 and a lower casing part 3.

According to FIG. 2, the upper casing part 2 features driving means 4 and adjustment devices 5 for adjusting the metering volume.

According to FIG. 8, on its lower end the lower casing part 3 comprises a cone 6 for putting up a pipette tip 7 and a displacement device 8 with a displacement chamber in the form of a cylinder 9 and a displacement member in the form of a plunger 10. The movement of the plunger 10 can be driven by means of the driving means 4.

According to FIG. 2, an adjustment sleeve 11 is mounted rotatably and axially stationary in the upper region of the upper casing part 2. The adjustment sleeve 11 is splinedly connected to an adjustment ring 12 at its topside, which features an axially reeded control portion 13 standing out of the upper casing part 2 at the topside. In the adjustment ring 12 is arranged a control button 14, which stands out of the upper casing part 2 still further towards the topside than the control portion 13.

The control button 14 is connected to a lifting rod 15, which is guided through a lead screw 16 in the upper casing part 2. The lead screw 16 is screwed into a lead screw nut 17, which is realised in one part with a lifting body 18 fixed in the upper casing part.

On the topside, the lead screw 16 has a follower 19 splinedly connected to it. On its perimeter, the follower 19 has two outwardly projecting diametrically opposed not inclined radial noses, which engage into axially running grooves 20 on the inner perimeter of the adjustment sleeve 11.

On its bottom side, the lead screw 16 has an end stop in the form of ribs 21 projecting radially towards the outside, which bear against an inner shoulder 22 of the lifting body 18 in the shown uppermost position, with which they co-operate.

According to FIG. 3, in conventional pipetting devices, a lead screw 16 made of metal with an external thread 23 realised as a thread with a triangular shape is screwed into lead screw nut 17 made of plastic material. Through this, an internal thread 24 is formed into the bore 25 of the lead screw nut 17. In this arrangement, the friction surface 26 between the lead screw 16 and the lead screw nut 17 is relatively large, and due to this a high torque must be applied in order to twist the lead screw 16. In pipetting devices of different magnitudes, which feature different adjustment ranges of the metering volumes, the pitch of the external thread 23 is different. As a consequence, the friction surfaces and the torques which must be applied in the adjustment are different.

By means of the FIGS. 4 and 5, the thread engagement of a lead screw 16 forming at least one internal thread 24 into the lead screw nut 17 is explained as an example.

According to FIG. 4, the single lead screw 16 features a first external thread 23.1 in a first portion, and in a second, neighbouring portion a second external thread 23.2. The first external thread 23.1 has a greater outer diameter than the second external thread 23.2. Core diameter, included thread angle and pitch of the first external thread 23.1 and the second external thread 23.2 are coincident. The first external thread 23.1 is realised as thread with a triangular shape and the second external thread 23.2 as a thread with a trapezoidal shape. In the adjustment range of the metering volumes, the lead screw 16 is screwed into the lead screw nut 17 only with the second external thread 23.2. The friction surface 26 and as a consequence the torque which must be applied are reduced. In particular, the friction intensive engagement of the tips of the external thread 23.1 into the internal thread 24 is avoided by doing so.

According to FIG. 5, the lead screw 16 is provided with a double threaded external thread 23 in one variant of the invention. In this, the second external thread 23.2 is cut deeper than the first external thread 23.1.

When screwing in the lead screw 16 into a lead screw nut 17 which is provided only with a bore 25 without thread, a double threaded internal thread 24 is formed in. As the second external thread 23.2 of the lead screw 16 is cut deeper than the first external thread 23.1, the friction surface 26 is reduced, and therefore also the torsional force. In particular, the friction intensive engagement of the tips of the internal thread 24 into the second external thread 23.2 is avoided. The depth of the second external thread 23.2 can be set in a variable manner, and thus every desired adjustment force can be realised. The guiding and the load bearing force of the lead screw 16 in the lead screw nut 17 are not essentially compromised by doing so.

By a variation of thread dimensions (e.g. of the outer diameter of the first or second external thread 23.1, 23.2 of FIG. 4 or of the inner diameter of the external threads 23.1, 23.2 of FIG. 5), every desired adjustment force can be realised. Through this, it is possible to provide pipetting devices for different metering ranges, in which the torque which must be applied for the adjustment is equal.

By means of FIGS. 6 and 7, the thread engagement of a lead screw 16 into a lead screw nut 17 forming at least one external thread is explained as an example.

According to FIG. 6, a single threaded lead screw nut 17 has a first internal thread 24.1 in a first portion, and in a neighbouring portion a further or second, respectively, internal thread 24.2. The first internal thread 24.1 and the second internal thread 24.2 have the same outer diameter and the same included thread angles. The inner diameter of the first internal thread 24.1 is smaller than the inner diameter of the second internal thread 24.2.

By screwing in an even cylindrical blank of a lead screw 16 into the first internal thread 24.1, a deeply cut single threaded external thread 23 is formed in the lead screw 16. The external thread 23 has a reduced friction force in the region of the second internal thread 24.2, because the same does not engage with tips into the external thread 23.

According to FIG. 7, a double threaded lead screw nut 17 has a first internal thread 24.1 with a smaller inner diameter and a further or second, respectively, internal thread 24.2 with a greater inner diameter. The outer diameters of the internal threads 24.1 and 24.2 are coincident.

By threading in an even cylindrical blank of a lead screw 16, a double threaded external thread with a first external thread 23.1 and with a further or second, respectively, external thread 23.2 is formed on the lead screw 16. In the region of the engagement of the first external thread 23.1 into the first internal thread 24.1, the friction surfaces are greater than in the region of the engagement of the second external thread 23.2 into the second internal thread 24.2. Already through this, the friction forces can be controlled. In addition, in a part of the lead screw nut (in the left part in FIG. 7), the tips of the first internal thread 24.1 are removed at 24.3, and the tips of the second internal thread 24.2 at 24.4, so that there is no engagement of the tips into the external threads 23.1, 23.2 and the friction force is reduced significantly further.

In all the variants of the invention of the FIGS. 4 to 7, on the second external thread (23.2) of the lead screw (16) or on the second internal thread (24.2) of the lead screw nut (17), the lead screw nut (17) features a distance d of the lead screw (16) in the radial direction R to the axis A of the lead screw (16) in the level h of the outer diameter and/or inner diameter of the external thread (23.2, 23) of the lead screw (16). In this, the axis A is the symmetry axis, and in case that the spindle is rotatable, it is also the rotational axis of the spindle. As is well known, the radial direction R stands perpendicular on the axis A and points away from the axis. Through the level h, a plane perpendicular to the rotational axis is designated, wherein the outer and the inner diameter, respectively, of the external thread (23.2, 23) lies in the radial direction R in the plane of the level h. The distance d defined in this way is preferably greater than 0.015 mm and particularly preferred it is selected in the range from 0.020 mm to 0.060 mm, like for instance d=0.025 mm and d=0.050 mm.

According to FIG. 2, the lifting rod 15 has an upper stop in the form of an outwardly projecting washer 27, which bears against the lower front side 28 of the lead screw 16 in the shown position, which forms a counter-stop. The upper stop limits the stroke travel of the lifting rod 15 towards the upside.

On the lower end of the lifting body 18, a washer-shaped carrier 29 is fixed, which has a laterally projecting, consolelike portion 30 on its diameter, on which is mounted a numerator 31. The lifting rod 15 is guided through the washer-shaped carrier 29.

The adjustment sleeve 11 has a toothed wheel 32 on the perimeter at the downside, and the numerator 31 features a further toothed wheel 33 on a starting roller. The little numeral wheels 34 of the numerator 31 are visible from the outside of the upper casing part 2 through a window 35 which features a transparent cover.

In order to couple the adjustment sleeve 11 and the numerator 31, a set of toothed wheels is shiftably mounted on an axis. The toothed wheel set is pressed against an axial stop by a helical spring in a position in which a first toothed wheel of the set meshes with the toothed wheel 32 of the adjustment sleeve 11, and a second toothed wheel of the set, splinedly connected with the first one, meshes with the further toothed wheel 33 on the starting roller. The set of toothed wheels is axially displaceable against the spring action, so that the first and the second toothed wheel come out of engagement.

The arrangement of toothed wheel set, axis and helical spring described above is covered up in FIG. 1. This arrangement is described in detail in the DE 10 2005 033 378 A1 or US 2007 014 696 A1, the entire contents of which is incorporated herein by reference, respectively, by means of the FIGS. 4 and 5. The explanations related to this are incorporated into the present application by reference.

A pot-shaped holder 35 of an overstroke system 36 is arranged in the upper casing part 2 below the lifting body 18. The holder 35 has an external thread, which is screwably arranged in an internal thread of a carrier 37 of the overstroke system 36 fixed in the upper casing part.

The holder 35 contains a dish-shaped lower stop for the washer 27 on the lifting rod 15. The lower stop is arranged below an upper, inwardly bent edge of the holder 35. An overstroke spring which supports itself on the bottom of the holder 35 presses the lower stop against the upper edge of the holder 35.

The lifting rod 15 is guided through central passages of the lower stop, through the overstroke spring realised as a helical spring and through a central passage in the bottom of the holder 35.

The dish-shaped stop, the inwardly bent upper edge of the holder and the overstroke spring are covered up in FIG. 1. The arrangement is in principle described in detail in the DE 10 2005 033 378 A1 or US 2007 014 696 A1, the entire contents of which is incorporated herein by reference, respectively, by means of the FIGS. 2 and 3. The explanations related to this are incorporated into the present application by reference.

Below the holder 35, a driven toothed wheel 38 of a bevel gear unit 39 is rotatably mounted, concentrically to the lifting rod 15, in the casing-stationary carrier 37 of the overstroke system 36. The driven toothed wheel 38 has ribs projecting on the inner perimeter, which engage into axially extending grooves on the outer perimeter of the holder 35, so that the driven toothed wheel is splinedly connected to the holder 35, but the holder 35 is axially displaceably with respect to the driven toothed wheel 38.

A driving toothed wheel 40 of the bevel gear unit 39 is connected to a tool application arrangement 42, accessible from the outside via a shaft 41 rotatably mounted in the carrier 37.

By putting on a tool on the tool application arrangement 42 and rotating the tool, it is possible to screw the holder 35 in the casing stationary carrier 47 into another position. As a consequence, the lower stop which limits the stroke travel path of the lifting rod 15 towards the bottom is shifted, an overstroke being possible however, which is accompanied by a deformation of the overstroke spring.

On the perimeter of the holder 35 there is a scale 43, which can be read out from the outside through a casing window provided with a marking. A similar construction is described in the DE 10 2005 033 378 A1 or US 2007 014 696 A1, respectively, by means of FIG. 7. The explanations related to this are incorporated into the present application by reference.

A further helical spring 44 is present between the washer-shaped carrier 29 and the casing stationary carrier 37, which the supports the lifting body 18 in the casing upper part 2 from the downside.

Below the overstroke system 36, there is an accommodation 45 in the casing upper part 2, which features plural essentially cylindrical portions 45.1, 45.2, 45.3. The accommodation 45 enlarges itself in steps towards an axial opening 46 on the lower end of the casing upper part 2.

On its lower end, the lifting rod 15 protrudes into the upper portion 45.3 of the accommodation 45. Further, an additional helical spring 47 is arranged in the casing upper part 2 in the upper portion 45.3 of the accommodation 45. The additional helical spring 47 is fixed on its upper edge in the casing upper part 2. On the lower edge of the central portion 45.2, the accommodation 45 has a washer-shaped nose 48 projecting towards the interior, which serves for the fixation of the casing lower part 3.

Further, the pipetting device 1 has a throw-off device 49. The same has a throw-off button 50 in the casing upper part 2, beneath the adjustment ring 13. The throw-off button 50 is connected to a throw-off rod 51, which runs through the casing upper part 2 parallel to the lifting rod 15.

The throw off rod 51 is supported in the casing upper part 2 via a further helical spring 52, so that the throw off button 50 is pressed into the depicted starting position, from which it can be pushed in against the action of the further helical spring 52.

The lower end of the throw off rod protrudes into a lateral expansion 53 of the lower portion 45.1 of the accommodation 45.

According to FIG. 5, the lower casing part 3 of the pipetting device 1 features two elastic tongues 55 on an upper, cylindrical portion 54, which are separated from the rest of the cylindrical portion 54 by lateral slits. Besides to that, the upper end of the elastic tongues 55 is separated by a slit 56 with respect to the upper part of the cylindrical portion 54. At the bottom, the elastic tongues 55 are connected to the rest of the cylindrical portion 54 in one part. On the upper end, the elastic tongues 55 each have a hook 57 projecting towards the outside, and in a distance to it each has one wedge-like projection 58 which is chamfered towards the downside.

An unlocking ring 59 is arranged on the cylindrical portion 54 on the outside. The unlocking ring 59 pushes against the wedge-like projections 58 when it is shifted towards the upside, so that the elastic tongues 55 are somewhat deflected.

Below the cylindrical portion 54, the lower casing part 3 has a short conical transition portion 60, and below that a longitudinal central portion, slightly tapering conically towards the downside. The cone 6 is arranged on the lower end of the central portion 61.

The lower casing part 3 houses the displacement device 8. The same has in the cone 6 the cylinder 9, to which is associated the plunger 10. In the shown starting position, the plunger 10 is arranged with its lower end in a seal 62 on the upper end of the cone 6.

The plunger 10 is guided through an axial passage channel 63 of the central portion 61, and at the topside it is held in a plunger holder 64, also cylindrical with a greater diameter. The plunger holder 64 is guided in the cylindrical passage channel 63 on its perimeter.

The plunger holder 64 extends towards the upside through a cylindrical hollow space 65 of the cylindrical portion 54, and at the topside it has a dish-shaped pressing plate 66, which protrudes from the cylindrical portion 54 in the shown position.

The cylindrical portion 54 bears a plunger holder 67 at its topside, which comprises plural arms 68, which are each one at a time fixed on the upper end of the cylindrical portion 54 and bear a circular disc 69 on the other end, against the lower side of which the pressing plate 66 bears. In this position, the plunger holder 67 is held by a plunger return spring 70 realised as a helical spring, which is supported on the bottom of the cylindrical portion 54 at the one end, and at the other end on the pressing plate 66. The plunger holder 67 has a central passage 71 in the circular disc 69, through which a lower portion of the lifting rod 15 can be inserted until it bears against the pressing plate 66.

The throw-off device 49 has a throw-off sleeve 72 on the lower casing part. The same is guided on the cylindrical portion 54 and the cone 6 at the outside. Correspondingly, the inner contour of the throw-off sleeve 72 is matched to the outer contours of the above mentioned portions of the lower casing part 3.

Further, the throw-off sleeve 72 has a shoulder 73 projecting laterally on the upper edge, which features an axial bore 74 for pressing in the lower end of the throw-off rod 51.

The pipetting device is to be utilised in the following way:

The upper casing part 2 and the lower casing part 3 can be joined to each other by axially inserting the cylindrical portion 54 into the accommodation, until the hooks 57 snap into place behind the washer-shaped projection 48, and by pressing in the throw-off rod 51 into the bore 73 of the throw-off sleeve 71. In doing so, the further helical spring 47 is somewhat compressed and biased by the cylindrical portion.

After joining the upper casing part 2 and the lower casing part 3, the lifting rod 15 grasps through the passage 71 and bears against the pressing plate 61 with its lower end.

In order to adjust a volume to be pipetted, the adjustment ring 13 is rotated, until the numerator 31 indicates the desired volume. In the rotation of the adjustment ring 13, the adjustment sleeve 5 and through this the follower 19 is rotated also. As a consequence, the lead screw rotates in the external thread 24 and is displaced axially in the casing upper part 2, taking the washer 27 with it and through this also the lifting rod 15. In this, the radial projections of the follower 19 are displaced axially along the grooves 20 on the inner side of the adjustment sleeve 11. Through this, the stroke travel path of the lifting rod 15 which can be performed upon actuation of the control button 14 is changed. The adjustment moment of different pipetting devices having different adjustment ranges is about the same.

Further, a pipette tip 7 is clamped on the lower end of the cone 6 with its upper tip opening 75. The pipette tip 7 has a lower tip opening 76 for picking up and discharging liquid.

When the pipette tip 7 is put on the cone 6, the put-up force increases in the progress of the put-up. When the put-up force exceeds the force by which the further helical spring 47 is biased, the cone 6 and with it the whole lower casing part 2 is pushed upward against the action of the helical spring 47. When the upper edge of the pipette tip 7 presses against the lower edge of the throw-off sleeve 72 forming a stop, a further lifting of the lower casing part 3 is prevented. The put-up force and with it the throw-off force required for throwing off are thus limited to a certain value. The above is described in detail in the EP 1557222 A2 or US 2005 155 439 A1, the entire contents of which is incorporated herein by reference, respectively. The explanations related to this are incorporated into the present application by reference.

For pipetting, the control button 14 is pressed downward, so that the plunger 10 displaces air out of the cylinder 9. Then, the pipette tip 7 is dipped into the liquid to be pipetted with its lower tip opening 76. Thereafter, the control button 14 is released. The plunger 10 as well as the lifting rod 15 are pushed back into their starting position by the plunger return spring 70. In doing so, the plunger 10 aspirates liquid into the pipette tip 7 through the lower tip opening 76.

Thereafter, the pipetting device 1 is directed to a delivery location with the pipette tip 7 fixed thereon. The liquid contained in the pipette tip 7 is discharged by pressing the control button 14 and dipping the plunger 10 into the cylinder 9 anew, and pressing out air until the washer 27 bears against the lower stop. A residual amount of the liquid can be blown out by an overstroke. After releasing the control button 14, plunger 10 and lifting rod 15 travel back into their starting position through the action of the plunger return spring 70.

For giving off the pipette tip, it is pressed on the throw-off button 50. As a consequence, the throw-off sleeve moves downward and pushes off the pipette tip 7 towards the cone 6.

In order to detach the casing lower part 3 from the casing upper part 2, at first the throw off sleeve 72 is taken off, and then the unlocking ring 59 is shifted somewhat upward, so that the hooks 57 snap in towards the inside. Through this, the casing lower part 2 is released, wherein it is pressed down by the biased further helical spring 47.

The casing upper part 2 is suited to be joined to a multichannel casing lower part, instead to the single channel lower casing part 3 described above. In principle, a multichannel casing lower part can be used like that shown in FIGS. 3 and 4 of the EP 1557222 A2 or US 2005 155 439 A1, the entire contents of which is incorporated herein by reference, respectively. The explanations related to this in the EP 1557222 A2 or US 2005 155 439 A1, the entire contents of which is incorporated herein by reference, respectively, are incorporated into the present application by reference. However, not conforming to the bayonet joint to the multichannel casing lower part described in the EP 1557222 A2 or US 2005 155 439 A1, the entire contents of which is incorporated herein by reference, respectively, a joint with elastic tongues 55 and unlocking ring 59 on an upper cylindrical portion 54 of the multichannel casing lower part is used for joining with the casing upper part 2, as shown in FIG. 5.

For a manufacturer's calibration, the scale 43 on the holder 35 is set to the zero point by means of a tool applied to the tool application arrangement 42. The manufacturer's calibration is performed in a state where the numerator 31 is uncoupled from the adjustment sleeve 11. In this, the numerator 31 is adjusted until the indicated metering volume corresponds to that one which is really metered according to measurement.

For temporary recalibration of the pipetting device 1 to deviant media and surroundings conditions like density, vapour pressure, temperature and so on, the overstroke system is adjusted by rotating a tool applied on the tool application arrangement 42. The user can then return to the manufacturer's calibration by rotating back the scale 43 to the zero point. This is described in detail in the DE 10 2005 033 378 A1 or US 2007 014 696 A1, the entire contents of which is incorporated herein by reference, respectively.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pipetting device with means (6) for detachably connecting with at least one pipette tip (7) and at least one displacement device (9, 10) having a displacement chamber (9) and a displacement member (10) movably arranged therein, for sucking in and ejecting liquid into and out of the at least one pipette tip (7), or means for detachably connecting with at least one syringe with a cylinder and a plunger relocatable therein, a lifting rod (15) for driving the displacement member (10) or the plunger of the at least one syringe, with a driving means (14) for driving the lifting rod (15), an adjustment device (5) for adjusting the metering volume with a lead screw nut (17) and a lead screw (16), wherein one of the components lead screw nut (17) and lead screw (16) is stationary with respect to the displacement chamber (9) or the cylinder of the connected syringe, and the other component is screwable with respect to the stationary component and has a stop (28), to which a counter-stop (27) of the lifting rod (15) is related, wherein the lead screw (16) has a first external thread (23.1) and at least one further external thread (23.2) with a thread form shaped different than that of the first external thread (23.1), and the lead screw nut (17) has at least one related internal thread (24), and wherein on the further external thread (23.2) of the lead screw (16) the lead screw nut (17) features at least in parts a distance (d) to the lead screw (16) in the radial direction (R) to the axis (A) of the lead screw (16) in the level (h) of the outer diameter and/or inner diameter of the external thread (23.2, 23) of the lead screw (16).

2. A pipetting device according to claim 1, characterised in that the related internal thread (24) of the lead screw nut (17) or the related external thread (23) of the lead screw (16) is produced or has been produced at least partly by screwing in the lead screw (16) into the lead screw nut (17) or by screwing on the lead screw nut (17) onto the lead screw (16).

3. A pipetting device according to claim 1, wherein the first external thread (23.1) has another outer diameter and/or another inner diameter and/or another included thread angle and/or another pitch diameter and/or another shape of the thread form than the further external thread (23.2).

4. A pipetting device according to claim 1, wherein in the whole adjustment range of the adjustment device (5), the further external thread (23.2) engages into the internal thread (24) produced by means of the lead screw (16).

5. A pipetting device according to claim 1, wherein the lead screw (16) or the lead screw nut (17) is single started, and the further external thread (23.2) is added to the first external thread (23.1).

6. A pipetting device according to claim 1, wherein the lead screw (16) or the lead screw nut (17) is multi started, and a first thread path is provided by the first external thread (23.1), and a further thread path is provided by the further external thread (23.1).

7. A pipetting device according to claim 1, wherein the internal thread (24) is produced by screwing in the lead screw (16) into an even cylindrical bore (25) of the lead screw nut (17), or the external thread (23) is produced by screwing in an even cylindrical lead screw (16) into the lead screw nut (17).

8. A pipetting device according to claim 1, wherein the internal thread (24) is produced by screwing in the lead screw (16) into a bore (25) of the lead screw nut (17), the bore (25) being provided with inwardly projecting noses, or the external thread (23) is produced by screwing in the lead screw (16), provided with outwardly projecting noses, into the lead screw nut (17).

9. A pipetting device according to claim 1, wherein the internal thread (24) is produced by screwing in the lead screw (16) into a lead screw nut (17) provided with a partly prefabricated internal thread, or the external thread (23) is produced by screwing in the lead screw (16) which is provided with a partly prefabricated external thread.

10. A pipetting device according to claim 1, wherein the external thread (24) or the internal thread is produced by machining and/or in a non-machining manner.

11. A pipetting device according to claim 1, wherein the first external thread (23.1) is a thread with a triangular shape, and the further external thread (23.2) is a thread with a trapezoidal shape.

12. A pipetting device according to claim 1, wherein the lead screw nut (17) is made at least in the region in which the internal thread (24) is produced by means of the lead screw (16) of a softer material than the lead screw (16) at least in the region of the external thread (23), or wherein the lead screw (16) is made at least in the region in which the external thread (23) is produced by means of the lead screw nut (17) of a softer material than the lead screw nut (17) at least in the region of the internal thread (24).

13. A pipetting device according to claim 1, wherein the lead screw nut (17) is made of a plastic at least in the region in which the internal thread (24) is produced by means of the lead screw (16), or the lead screw (16) is made of a plastic at least in the region in which the external thread (23) is produced by means of the lead screw nut (17).

14. A pipetting device according to claim 1, wherein the lead screw (16) producing the internal thread (24) is made of a metal at least in the region of the external threads (23.1, 23.2), or the lead screw nut (17) producing the external thread (23) is made of a metal at least in the region of the internal threads (24).

15. A pipetting device according to claim 1, wherein the torque for moving the lead screw (16) in the lead screw nut (17) is about 50 mNm at maximum.

16. A pipetting device according to claim 1, characterised in that on the further external thread (23.2) of the lead screw (16), the lead screw nut (17) features a distance (d) to the lead screw (16) in the radial direction (R) to the axis (A) of the lead screw (16) in the level (h) of the outer diameter and/or inner diameter of the external thread (23.2, 23) of the lead screw (16).

17. A pipetting device according to claim 1, characterised in that the distance of the lead screw nut (17) to the lead screw (16) on the further external thread (23.2) of the lead screw (16) or the further internal thread (24.2) of the lead screw nut (17) in the radial direction (R) to the axis (A) of the lead screw (16) in the level (h) of the outer diameter and/or inner diameter of the external thread (23.2, 23) of the lead screw (16) is greater than 0.015 mm.

18. A pipetting device according to claim 1, characterised in that the distance of the lead screw nut (17) to the lead screw (16) on the further external thread (23.2) of the lead screw (16) is in the range from 0.020 mm to 0.060 mm.

19. A pipetting device with means (6) for detachably connecting with at least one pipette tip (7) and at least one displacement device (9, 10) having a displacement chamber (9) and a displacement member (10) movably arranged therein, for sucking in and ejecting liquid into and out of the at least one pipette tip (7), or means for detachably connecting with at least one syringe with a cylinder and a plunger relocatable therein, a lifting rod (15) for driving the displacement member (10) or the plunger of the at least one syringe, with a driving means (14) for driving the lifting rod (15), an adjustment device (5) for adjusting the metering volume with a lead screw nut (17) and a lead screw (16), wherein one of the components lead screw nut (17) and lead screw (16) is stationary with respect to the displacement chamber (9) or the cylinder of the connected syringe, and the other component is screwable with respect to the stationary component and has a stop (28), to which a counter-stop (27) of the lifting rod (15) is related, wherein the lead screw nut (17) has a first internal thread (24.1) and at least one further internal thread (24.2) with a thread form shaped different than that of the first internal thread, and the lead screw (16) has at least one related external thread (23), and wherein on the further internal thread (24.2) of the lead screw nut (17), the lead screw nut (17) features at least in parts a distance (d) to the lead screw (16) in the radial direction (R) to the axis (A) of the lead screw (16) in the level (h) of the outer diameter and/or inner diameter of the external thread (23.2, 23) of the lead screw (16).

20. A pipetting device according to claim 19, wherein the first internal thread (24.1) has another outer diameter and/or another inner diameter and/or another included thread angle and/or another pitch diameter and/or another shape of the thread form than the or the further internal thread (24.2).

21. A pipetting device according to claim 19, wherein in the whole adjustment range of the adjustment device (5), or the external thread (23) produced by means of the lead screw nut (17) engages into the further internal thread (24.2).

22. A pipetting device according to claim 19, wherein the lead screw (16) or the lead screw nut (17) is single started, and the further internal thread (24.2) is added to the first internal thread (24.1).

23. A pipetting device according to claim 19, wherein the lead screw (16) or the lead screw nut (17) is multi started, and the first internal thread (24.1), and a further thread path is provided by the further internal thread (24.2).

24. A pipetting device according to claim 19, wherein or the first internal thread (24.1) is a thread with a triangular shape, and the further internal thread (24.2) is a thread with a trapezoidal shape.

25. A pipetting device according to claim 19, characterised in that or on the further internal thread (24.2) of the lead screw nut (17), the lead screw nut (17) features a distance (d) to the lead screw (16) in the radial direction (R) to the axis (A) of the lead screw (16) in the level (h) of the outer diameter and/or inner diameter of the external thread (23.2, 23) of the lead screw (16).

26. A pipetting device according to claim 19, characterised in that or the further internal thread (24.2) of the lead screw nut (17) in the radial direction (R) to the axis (A) of the lead screw (16) in the level (h) of the outer diameter and/or inner diameter of the external thread (23.2, 23) of the lead screw (16) is in the range from 0.020 mm to 0.060 mm.

* * * * *